United States Patent [19]

Taplin et al.

[11] Patent Number: 5,048,561

[45] Date of Patent: Sep. 17, 1991

[54] BIDIRECTIONAL CHECK VALVE

[75] Inventors: Lael B. Taplin, Union Lake; Vinod K. Nanda, Rochester, both of Mich.

[73] Assignee: Vickers, Incorporated, Troy, Mich.

[21] Appl. No.: 609,368

[22] Filed: Nov. 5, 1990

Related U.S. Application Data

[62] Division of Ser. No. 341,213, Apr. 21, 1989, Pat. No. 4,993,921.

[51] Int. Cl.[5] ..... F16K 17/26

[52] U.S. Cl. ..... 137/493.9; 137/493

[58] Field of Search ..... 137/493, 493.9

[56] References Cited

U.S. PATENT DOCUMENTS

| | | | |
|---|---|---|---|
| 2,681,074 | 6/1954 | Frentzel | 137/493 |
| 2,804,881 | 9/1957 | Seid et al. | 137/493 |
| 2,951,500 | 9/1960 | Hunter | 137/493 X |
| 2,991,797 | 7/1961 | Baldwin | 137/493 |
| 3,067,770 | 12/1962 | Fancher | 137/493 |
| 3,131,715 | 5/1964 | Sanders | 137/493 |
| 4,119,351 | 10/1978 | Durling | 137/493.9 X |

FOREIGN PATENT DOCUMENTS

| | | | |
|---|---|---|---|
| 746913 | 3/1956 | United Kingdom | 137/493 |

*Primary Examiner*—John Rivell

*Attorney, Agent, or Firm*—Barnes, Kisselle, Raisch, Choate, Whittemore & Hulbert

[57] ABSTRACT

A bidirectional check valve that includes a housing having an internal cavity with fluid openings at axially opposed ends. A first valve element comprises a cup-shaped sleeve having a base adjacent to one axial end of the cavity and a sidewall axially slidably embraced by the housing within the cavity. A first fluid passage extends through the base of the sleeve adjacent to one of the cavity openings. A second valve element comprises a spool telescopically slidably received within the sidewall of the sleeve. A second fluid passage extends through the spool end from adjacent the second end of the housing cavity to internally adjacent the sidewall of the sleeve. A fluid passage is formed between the radially opposed surfaces of the sleeve and the spool for passing fluid therethrough as a function of axial position of the sleeve and spool with respect to each other. A coil spring is captured in compression between the sleeve and the spool so as to urge the valve elements toward respective ends of the housing cavity. The fluid passage between the radially opposing surfaces of the sleeve and spool comprises at least one channel formed in the outer wall of the spool. The channel has a cross section to fluid flow that varies as a function of axial position of the valve elements with respect to each other. To restrict fluid passage at high flow rates, one or both of the housing fluid openings may comprise a damping orifice of preselected diameter.

6 Claims, 2 Drawing Sheets

BIDIRECTIONAL CHECK VALVE

This is a divisional of copending application Ser. No. 07/341,213 filed on Apr. 21, 1989 now U.S. Pat. No. 4,993,921.

The present invention relates to hydraulic control systems, and more particularly to pressure compensation of a variable displacement hydraulic pump.

BACKGROUND AND OBJECTS OF THE INVENTION

There are many instances in hydraulic control systems in which a lag network is connected between a hydraulic pressure line and a fluid control mechanism for restricting flow of fluid to the mechanism and thereby delaying and damping response of the control mechanism to fluctuations in fluid pressure at the fluid line. One example where a lag network of this character might be employed is in load-sensing pressure compensation of a variable displacement hydraulic pump of the type disclosed in U.S. Pat. No. 4,695,230. Delay and damping of the compensation control system helps eliminate pressure pulsations to the control mechanism, and thereby helps prevent oscillating movement of the pump displacement control under heavy pump load.

Conventionally, a lag network of the subject character comprises an orifice positioned in the hydraulic line to cooperate with a volume downstream of the orifice, formed by the line itself or by a separate accumulator, to restrict fluid flow. Such orifice/volume combination exhibits the desirable characteristic of attenuating the oscillating pressure on the volume resulting from oscillating flows passing through the orifice resistance. However, the orifice resistance to fluid flow is highly non-linear, and approaches zero as total fluid flow approaches zero. (The term "orifice resistance" refers to incremental resistance—i.e., a change in pressure divided by a change in flow about some steady operating flow through the orifice.) Thus, the filtering or attenuating property of the orifice/volume network fails at low flows because the orifice resistance approaches zero.

It is therefore a general object of the present invention to provide a hydraulic control system embodying a lag network between the primary fluid pressure line and the fluid control mechanism that exhibits or is characterized by a resistance to fluid flow that increases as fluid flow approaches zero. Another and related object of the invention is to provide a system of the described character that maintains resistance at low flow as described, while at the same time exhibiting either constant resistance or increasing resistance to flow as flow increases.

A further object of the invention is to provide a variable displacement pump control system that includes a pressure compensation network embodying such a lag network for controlling pump displacement as a function of load pressure.

Yet another object of the invention is to provide a bidirectional check valve for in-line connection in a hydraulic fluid system that achieves a more nearly constant resistance with changes in fluid flow, particularly at low flow.

SUMMARY OF THE INVENTION

A hydraulic control system in accordance with a first important aspect of the present invention compri es a hydraulic pressure line, a hydraulic fluid control mechanism and a lag network coupling the pressure line to the control mechanism for restricting flow of hydraulic flow therethrough, and thereby delaying and damping response of the control mechanism to fluid pressure fluctuations at the hydraulic line. The lag network comprises a check valve that includes a flow passage interconnecting the hydraulic line and the control mechanism, a valve element, and a spring resiliently urging the valve element to close the passage, such that resistance to fluid flow increases as fluid flow decreases in the hydraulic line feeding the control mechanism. Preferably, a pair of such check valves are connected in parallel between the hydraulic pressure line and the control mechanism for controllably restricting fluid flow in both directions. To offset decreasing resistance as a function of increasing fluid flow through the check valve or valves, an orifice that exhibits increasing resistance as function of fluid flow may be connected in series with the valves. This technique tends to linearize further the pressure drop/flow characteristics of the combination.

In accordance with a second important aspect of the present invention, a pressure compensated variable displacement hydraulic pump control system comprises a variable displacement hydraulic pump including a displacement control yoke and a fluid output. A hydraulic pressure line is connected through a control valve system to the pump output, and a compensation network is responsive to fluid pressure at the pressure line to control displacement of the pump. A check valve, preferably a pair of parallel reversed check valves as previously described, are connected between the fluid pressure line and the pressure compensation mechanism for restricting and damping fluid flow to the control mechanism. Thus, pressure fluctuations at higher frequencies are isolated from the compensation network, subsequent oscillations at the pump output and load are reduced, and a higher degree of pump stability is obtained.

In accordance with a third important aspect of the present invention, the parallel oppositely-poled check valves previously described are provided in a single bidirectional hydraulic check valve assembly that includes a housing having an internal cavity with fluid openings at axially opposed ends. A first valve element comprises a cup-shaped sleeve having a base adjacent to one axial end of the cavity and a sidewall axially slidably embraced by the housing within the cavity. A first fluid passage extends through the base of the sleeve adjacent to one of the cavity openings. A second valve element comprises a spool telescopically slidably received within the sidewall of the sleeve. A second fluid passage extends through the spool end from adjacent the second end of the housing cavity to internally adjacent the sidewall of the sleeve. A fluid passage is formed between the radially opposing surfaces of the sleeve and the spool for passing fluid therethrough as a function of axial position of the sleeve and spool with respect to each other. A coil spring is capture in compression between the sleeve and spool so as to urge the valve elements toward respective ends of the housing cavity. In the preferred embodiment of the invention, the fluid passage between the radially opposing surfaces of the sleeve and spool comprises at least one channel, and preferably a pair of diametrically opposed channels, formed in the outer wall of the spool. The channel or channels have a cross section to fluid flow that varies as a function of axial position of the valve elements with respect to each other. To restrict fluid passage at high fluid flow rates, one or both of the housing fluid openings may comprises a damping orifice of preselected diameter.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF THE PREFERRED EMBODIMENTS

Figure 1:
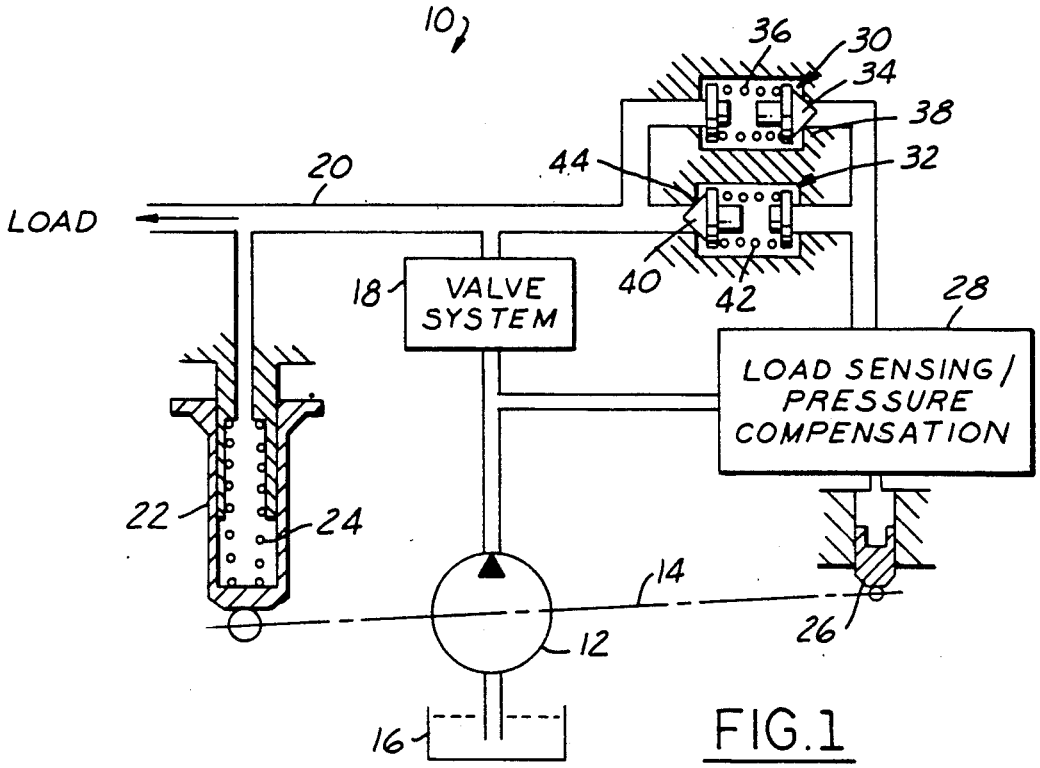
FIG. 1 is a hydraulic schematic diagram of a pressure-compensated variable displacement pump control system in accordance with the present invention.

FIG. 1 illustrates a pressure-compensated variable displacement hydraulic pump control system 10 in accordance with one presently preferred embodiment of the invention as comprising a variable displacement pump 12 having a swash plate 14 movable to vary displacement or stroke of the pump pistons. Pump 12 feeds fluid under pressure from a sump 16 through a system 18 of control valves to a fluid pressure line 20 for direction to a hydraulic load (not shown). A piston 22 is urged by a coil spring 24 and by the pressure of fluid in line 20 to position swash plate 14 for maximum pump displacement. A larger yoke-positioning piston 26 acts on swash plate 14 in opposition to piston 22. A system of load-sensing and pressure-compensation spool valves 28 receives hydraulic pressure from the output of pump 12 and from fluid pressure line 20, and controls position of piston 26 as a function thereof. U.S. Pat. No. 3,554,093 discloses a typical pump 12 of the type illustrated in FIG. 1. To the extent thus far described the pump control system of FIG. 1 is as illustrated, and described in greater detail, in U.S. Pat. No. 4,695,230, the disclosure of which is incorporated herein by reference.

In accordance with the present invention, a pair of oppositely-orientated or oppositely-polarized check valves 30, 32 are connected in parallel between fluid line 20 and load-sensing/pressure-compensation system 28. In particular, valve 30 comprises a valve element 34 that is resiliently urged by a coil spring 36 against a seat 38 for blocking flow of fluid from line 20 to system 28, while valve 32 comprises an element 40 resiliently urged by a coil spring 42 against a seat 44 for blocking flow of fluid from system 28 to line 20. However, each valve 30, 32 permits flow of fluid opposite to such check direction, with the resistance to fluid flow varying as an inverse function with magnitude of fluid flow. That is, resistance of valve 32 to fluid flow from left to right (in the orientation of FIG. 1) approaches infinity at zero flow (and a negative flow), but decreases with fluid flow from left to right that urges element 40 away from seat 44 against the force of spring 42. Likewise, resistance of valve 30 to fluid flow from right to left approaches infinity at zero (and negative) fluid flow, but decreases with increasing fluid flow against the force of spring 36.

Figure 3:
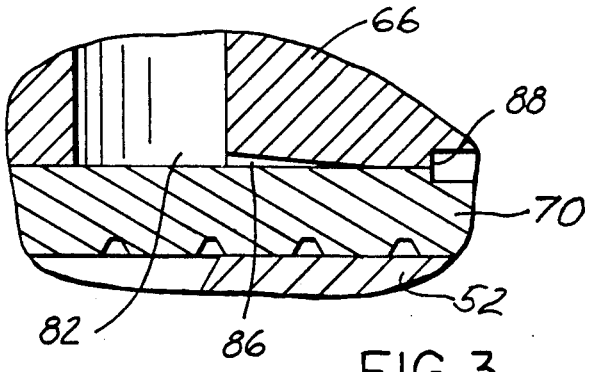
FIG. 3 is a fragmentary view on an enlarged scale of that portion of FIG. 2 enclosed by the line 3.
Figure 2:
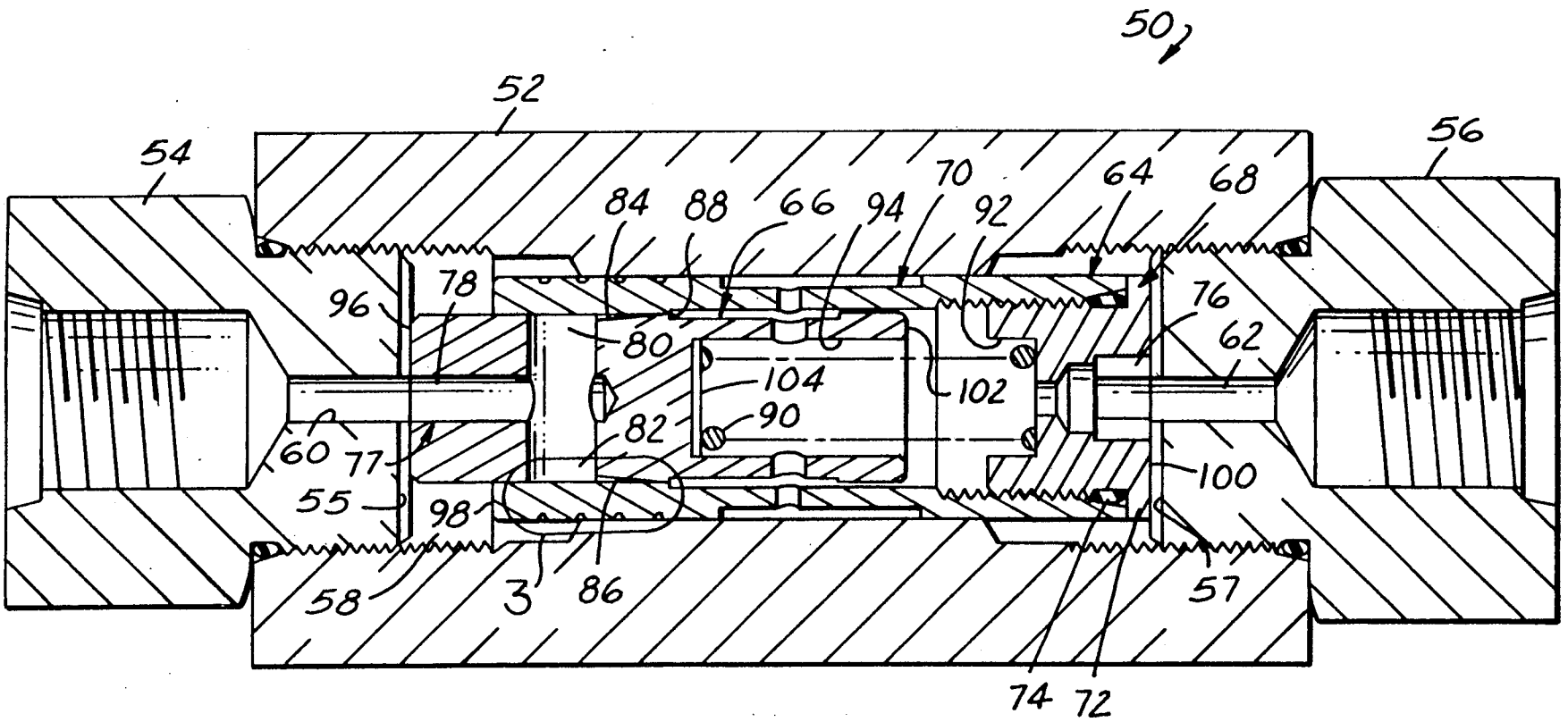
FIG. 2 is a sectioned side elevational view diametrically bisecting a bidirectional check valve in accordance with a presently preferred embodiment of the invention.

FIGS. 2 and 3 illustrate a bidirectional check valve assembly 50 in accordance with a presently preferred embodiment of the invention that combines both check valves 30, 32 of FIG. 1 into a unitary assembly. Valve assembly 50 comprises a cylindrical housing 52 having a pair of end plugs 54, 56 threadably received therewithin. End plugs 54, 56 have respective diametric channels 55, 57 on the inbound faces thereof. Housing 52 and end plugs 54, 56 together define an axially oriented internal fluid cavity 58 that is open at opposed cavity ends through coaxial fluid openings 60, 62 in end plugs 54, 56. A pair of check valve elements 64, 66 are telescopically slidably disposed within cavity 58. Valve element 64 comprises an end cap 68 threaded into one end of a hollow cylindrical sleeve 70. Cap 68 has an end flange 72 that captures a sealing ring 74 against the opposing end of sleeve 70 to form the generally cup-shaped contour of valve element 64. A fluid passage 76 extends through cap 68 coaxially with housing 52 and fluid openings 60, 62.

Valve element 66 comprises a spindle telescopically slidably positioned within sleeve 70. A T-shaped fluid passage 77 includes a central passage 78 that opens adjacent to and coaxially with opening 60 in plug 54, and a pair of diametrically oppositely oriented passages 80, 82 that extend from central passage 78 to the sidewalls of spindle 66 adjacent to the opposing inner wall surface of sleeve 70. A pair of channels 84, 86 extend axially from the ends of passages 80, 82 along the outer surface of spindle 66 toward a cylindrical shoulder 88 on the opposing inner wall surface of sleeve 70. Channels 84, 86 taper narrowingly from passages 80, 82 toward shoulder 88. A coil spring 90 is captured in compression between an internal pocket 92 in end cap 68 and an opposing internal pocket 94 in spindle 66. Coil spring 90 thus urges valve elements 64, 66 axially outwardly toward abutment with associated end caps 56, 54 to the zero-flow position illustrated in FIGS. 2 and 3.

In operation, and first assuming fluid pressure from left to right in the orientation of FIGS. 2 and 3, fluid enters cavity 58 through end plug 54 and passage 60. The pressure of hydraulic fluid against the opposing end surface 96 of spindle 66 urges spindle 66 to the right in FIG. 2 against the force of coil spring 90. At the same time, pressure against annular end surface 98 of sleeve 70, which preferably is equal in area to end surface 96 of spindle 66, cooperates with spring 90 to urge valve element 64 to the right against the opposing face of plug 56. As spindle 66 moves to the right under force of fluid pressure, channels 84, 86 begin to overlap shoulder 58, so that fluid flows through the channels past shoulder 88 into the volume between spindle 66 and end cap 68, and then through passage 76 and opening 62 out of the valve assembly. Increased fluid pressure from left to right increases motion of spindle 66 to the right, permitting greater fluid flow through channels 84, 86. It will be appreciated that the tapering contours of channels 84, 86 illustrated in the drawings are merely exemplary, and that other channel configurations and geometries may be employed to obtain fluid flow of any desired characteristics.

In like manner, and this time assuming fluid pressure from right to left in FIG. 2, pressure on the end surface 100 of cap 68 urges valve element 64 to the left in FIG. 2. At the same time, fluid pressure on annular end surface 102 and base 104 of pocket 94, which together preferably equal the surface area of end 100, urges spindle 66 to the left. As fluid pressure increases, shoulder 88 is brought into radial registry with channels 84, 86, so that fluid can flow through the channels, through passages 80, 82, 78, and thence through opening 60 of plug 54. Thus, valve assembly 50 effectively functions as parallel check valves of opposite polarity of the character schematically illustrated at 30, 32 in FIG. 1.

We claim:

1. A bidirectional hydraulic check valve that comprises:

a housing that includes means defining an internal cavity having an axial dimension and fluid openings at axially opposed ends of said cavity, a first valve element that comprises a cup-shaped body having a base adjacent to one axial end of said cavity, a sidewall axially slidably embraced by said housing within said cavity and first fluid passage means extending through said base, a second valve element that comprises a body telescopically slidable embraced within said sidewall of said first element, and second fluid passage means that extends through said body from a first end adjacent to the other axial end of said cavity to a second end internally adjacent to said sidewall of said first valve element, third fluid passage means between said first and second valve elements variably connecting said second end of said second passage means to said first passage means as a function of axial positions of said first and second valve elements with respect to each other, and spring means captured between said first and second valve elements and urging said valve elements toward respective ends of said cavity.

2. The valve set forth in claim 1 wherein said third fluid passage means comprises an internal shoulder in said sidewall of said first valve element positioned to close said second end of said second passage means when said valve elements are positioned by said spring means at said axially opposed ends of said cavity.

3. The valve set forth in claim 2 wherein said shoulder is axially spaced from said second end of said second passage means when said valve elements are positioned at said opposed ends of said cavity, and wherein said third passage means further comprises a channel in an outer surface of said second valve element opposed to said sidewall and extending longitudinally from said second end of said second passage means toward said shoulder.

4. The valve set forth in claim 3 wherein sad channel has a cross section to fluid flow that varies longitudinally thereof.

5. The valve set forth in claim 3 wherein said second passage means comprises a T-shaped passage having diametrically opposed second ends, and wherein said third passage means comprises a diametrically opposed pair of said channels in said outer surface of said second valve element.

6. The valve set forth in claim 5 wherein at least one of said openings comprises an orifice of predetermined dimension for exhibiting a resistance to fluid flow that increases as a function of fluid flow.

* * * * *